United States Patent [19]

Lightsey

[11] 4,341,306

[45] Jul. 27, 1982

[54] DISPOSABLE RAZOR PACKAGE

[75] Inventor: Martin F. Lightsey, Staunton, Va.

[73] Assignee: American Safety Razor Company, Verona, Va.

[21] Appl. No.: 133,779

[22] Filed: Mar. 26, 1980

[51] Int. Cl.[3] ..... B65D 75/58; A45D 27/29

[52] U.S. Cl. ..... 206/372; 206/44.12; 206/45.12; 206/485

[58] Field of Search ..... 206/372, 305, 354, 362, 206/369, 370, 171, 175, 429, 349, 45.14, 44.12, 485, 228, 44.11; 248/152

[56] References Cited

U.S. PATENT DOCUMENTS

| | | | |
|---|---|---|---|
| 1,192,859 | 8/1916 | Camfield | 206/44.12 |
| 1,194,372 | 8/1916 | Fischer | 206/44.12 |
| 1,860,324 | 5/1932 | Einson | 206/44.12 |
| 1,956,642 | 5/1934 | Einson | 206/44.12 |
| 2,968,392 | 1/1961 | Schmeler | 206/45.14 |
| 3,207,303 | 9/1965 | Breedneld | 206/426 |
| 3,587,837 | 6/1971 | Smith | 206/45.14 |
| 3,797,729 | 3/1974 | Holmes | 206/175 |
| 3,884,350 | 5/1975 | Johansson | 206/44.12 |
| 3,978,980 | 9/1976 | Roccaforte | 206/45.14 |
| 4,266,664 | 5/1981 | Dixon | 206/349 |

*Primary Examiner*—Herbert F. Ross

*Attorney, Agent, or Firm*—Wender, Murase & White

[57] ABSTRACT

An internally hollow package includes front, rear and side panels. A pair of aligned openings are cut in the front and rear panels leaving corresponding flaps contiguous with an end panel. The flaps and the end panel abut and secure the heads of a set of razors. The razor handles are positioned between the front and rear panels and extend toward an opposite end panel having an opening formed therein through which the razor handles pass and remain secured. Two sets of razors are oppositely positioned in symmetrical relation to each other thus permitting the package to be hung straight from a central mounting hole located equidistant from the end panels.

6 Claims, 4 Drawing Figures

DISPOSABLE RAZOR PACKAGE

FIELD OF THE INVENTION

The present invention relates to package construction and more particularly to a package formed from a single blank for accommodating disposable safety razors.

BRIEF DESCRIPTION OF THE PRIOR ART

The closest-known prior art is a disposable razor package marketed by The Gillette Company for its product known as GOOD NEWS. This package contains six disposable razors having all their heads aligned at one side of the package, while the handles are similarly aligned at an opposite side of the package. The heads are restrained by flaps, as in the case of the present invention, and an opening in the side panel of the package receives the handle end portions. A mounting hole is positioned along a top edge portion of the package, as is also the case with the present invention. However, due to the fact that all of the heads are positioned on one side of the package and the handles on the other, when such a package is to be mounted from a peg on a product display rack, the mounting hole must be formed in an offset relationship to the symmetrical axis of the package. This type of situation may require utilization of display racks which are nonstandard thereby requiring extra expenses to be incurred. If a standard display rack is to be employed, the number of packages to be mounted will be fewer than if a symmetrically positioned mounting hole characterized the package.

BRIEF DESCRIPTION OF THE PRESENT INVENTION

The present invention eliminates the disadvantages of the prior art by permitting the positioning of a first set of razors in opposing symmetrical relationship to a second set, all within one package. Accordingly, the weight distribution of the razors is symmetrical, relative to a center line for the package.

The above-mentioned objects and advantages of the present invention will be more clearly understood when considered in conjunction with the accompanying drawings, in which:

DETAILED DESCRIPTION OF THE INVENTION

Figure 1:
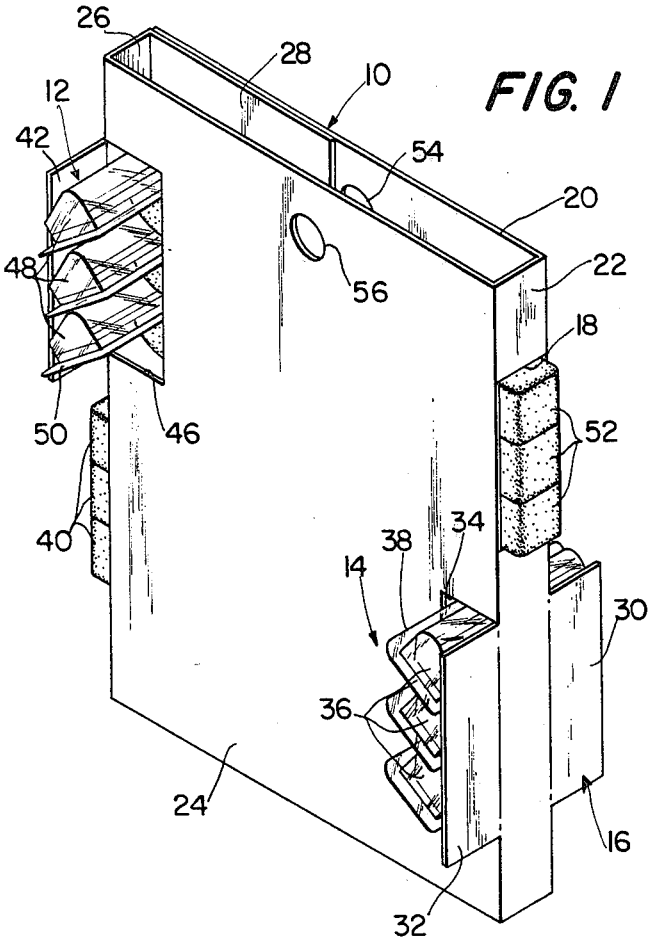
FIG. 1 is a perspective view illustrating the present package with two tri-sets of confronting razors secured within the package.

Referring to the figures and more particularly FIG. 1 thereof, reference numeral 10 generally indicates the package which is the present invention and which is preferably formed from a single blank typically made from conventional materials such as cardboard and capable of having printed material thereon. A first set of disposable safety razors 12 is seen secured within the package. Hereinafter, the razor set 12 will be referred to as a tri-set. A second, identical razor tri-set 14 is shown positioned within the package and disposed in oppositely confronting relationship to the first tri-set 12.

Although the present invention will be described in conjunction with two alternating tri-sets of razors equalling a total of six razors, it is to be appreciated that more or fewer razors may constitute a set and more than two sets may be packaged. An important consideration resides in the fact that each set alternates with respect to another and that an even number of identical sets be used. As will be seen from the lower portion of FIG. 1, the heads of the razors are restrained by abutments or winged flaps 16 cut from the package blank, the flaps being separated by an intermediate portion of the package end panel. The handle ends of the razors extend through a rectangular opening such as 18 formed in an oppositely confronting end panel. The orientation of the razor tri-sets may also be changed as desired (i.e., head up or head down).

Figure 3:
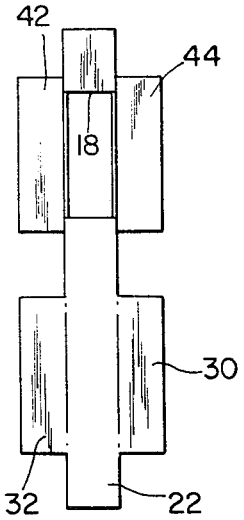
FIG. 3 is an end elevational view of the present package.
Figure 4:
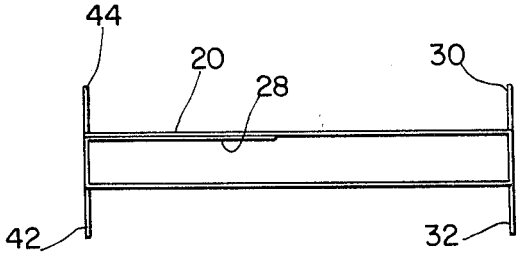
FIG. 4 is a top plan view of the present package.

Considering the package construction in greater detail, the rectangular blank includes a number of articulations to form: a rear panel 20, right side panel 22, front panel 24, left side panel 26 and end panel 28, the latter overlying the rear panel 20 and preferably pasted or stapled to it. Individual flap members 30 and 32 are formed from the blank so as to articulate from the right side panel 22 to be contiguous therewith. By forming these flaps, rectangular openings 34 are cut in the front and rear panels 24, 20 so as to be in registry with one another. Thus far described, the flaps 30, 32 and the rectangular opening 34 provide excellent securement for the head portions 36 of the razor tri-set 14. A thin plastic cap 38 is previously mounted to each razor head to prevent accidental contact with a razor edge. The handle ends 40 of the razor tri-set 14 pass outwardly through a rectangular opening in left side panel 20, such as 18, the opening being of such dimension to tightly receive the handle ends 40. As will be seen from FIGS. 3 and 4, a second set of flaps 42 and 44, comparable to the first mentioned set 30, 32 secures the heads of the razor tri-set 12. As in the case of the previously discussed tri-set 14, the razors of the tri-set 12 include heads 48, received in opening 46, and which are covered by plastic caps 50. The heads 48 of the razor tri-set 12 are positioned above the handle ends 40 of the razor tri-set 14. The handles 52 of the razor tri-set 12 are positioned above the heads 36 of the razor tri-set 14.

Figure 2:
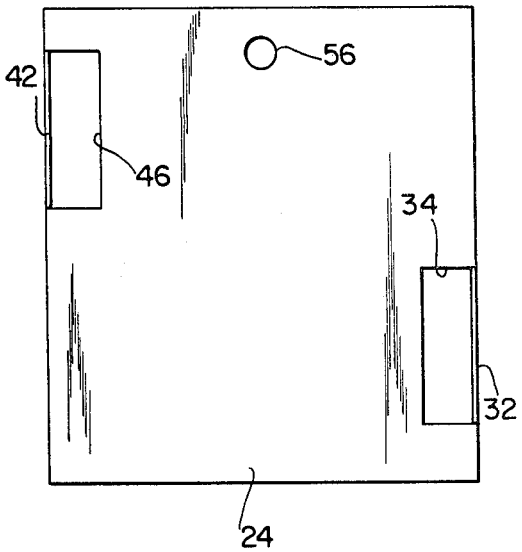
FIG. 2 is a front elevational view of the present package.

Apertures 54 and 56 are formed, in registry, in the rear panel 20 and front panel 24. Each of these apertures is located equidistant from side panels 22 and 26 most evident in FIG. 2. Due to the symmetrical weight distribution of the razors within package 10, the package will hang straight from the centrally located apertures.

In utilization of the invention, the package 10 is perfectly sufficient to safely contain the razors without the addition of a protective cover or bag.

Although the present package structure has been described with reference to disposable safety razors, it should be understood that it is likewise applicable for containing other elongate articles of uneven weight distribution. Accordingly, the invention is directed to the package structure, per se, and not necessarily in combination with a particular product. Further, although the present invention has been described as a package for containing a plurality of articles, it should be understood that the inventive package may be used for a single symmetrical article or two identical articles positioned in opposing confronting relationship with each other.

It should be understood that the invention is not limited to the exact details of construction shown and described herein for obvious modifications will occur to persons skilled in the art.

I claim:

1. A hollow package for safety razors, each razor having a head and a handle, the package comprising:

front, rear and side panels articulated together;

first means formed in the front and rear panels for securing the heads of a first plurality of razors therein;

second means formed in a first side panel, opposite the first means, for supporting the handles of the first plurality of razors therein;

third means formed in said front and rear panels substantially identical to and formed diammetrically opposite the first means and adjacent said second means for securing the heads of a second plurality of razors therein; and fourth means substantially identical to the second means and formed adjacent said first means in a second side panel, opposite the first side panel, for supporting the handles of the second plurality of razors therein so that said second plurality of razors are in an opposite symmetrical relationship and vertically aligned with respect to said first plurality of razors to thereby provide symmetrically distributed weight relative to the central longitudinal axis of the package.

2. The subject matter of claim 1 wherein the first and third means each includes aligned apertures formed in the front and rear panels; and flap members extending laterally outwardly from the aligned apertures for abutting the razor heads.

3. The subject matter set forth in claim 2 together with aligned openings formed in the front and rear panels, equidistant from the side panels for permitting level hanging of the package.

4. A package for holding articles and having front, rear, first and second side panels, the package comprising:

a first pair of flaps cut out from the front and rear panels, each flap connected to a first side panel and resulting in the formation of aligned openings in the front and rear panels for receiving an end portion of a first article, said first pair of flaps and first side panel restraining outward article displacement from the package;

a first opening formed in the second side panel, opposite said first pair of flaps, for receiving an opposite end of the first article;

a second pair of flaps positioned diametrically opposite said first pair and likewise cut out from the front and rear panels, said second pair of flaps being connected to the second side panel adjacent said first opening and resulting in the formation of aligned openings in the front and rear panels for receiving an end portion of a second article; and a second opening formed in the first side panel adjacent said first pair of flaps and opposite said second pair of flaps, for receiving an opposite end of the second article, whereby the first and second articles are in an opposite symmetrical relationship vertically aligned with respect to each other and symmetrically distributed in weight relative a central longitudinal axis of the package.

5. The subject matter of claim 4 together with aligned holes in registry with each other formed in the front and rear panels at points equidistant from the side panels to permit level hanging of the package.

6. The subject matter set forth in claim 4 wherein the package is formed from a single blank of material.

* * * * *